United States Patent [19]

Skwara

[11] 4,166,578

[45] Sep. 4, 1979

[54] OSCILLATING LAWN SPRINKLER

[76] Inventor: Leo Skwara, 646 Bechard Rd., Kelowna, British Columbia, Canada, V1Y 4V8

[21] Appl. No.: 887,014

[22] Filed: Mar. 16, 1978

[51] Int. Cl.[2] ..... B05B 3/16

[52] U.S. Cl. ..... 239/242

[58] Field of Search ..... 74/25 R, 803; 239/242

[56] References Cited

U.S. PATENT DOCUMENTS

| | | | |
|---|---|---|---|
| 1,454,844 | 5/1923 | Campbell | 239/242 |
| 1,534,979 | 4/1925 | McGee | 239/242 |

*Primary Examiner*—John J. Love

*Attorney, Agent, or Firm*—Howard I. Podell

[57] ABSTRACT

An oscillating lawn sprinkler which gives more uniform distribution of water and includes a base, a water driven motor mounted in the base, a crown gear attached to the base, a pinion on the gear meshing therewith, a link having one end connected to the center of the pinion and the other to the drive shaft of the motor concentric with the gear and a connecting rod pivoted to the perimeter of the pinion gear and to one end of rocking arm of the sprinkler outlet.

3 Claims, 5 Drawing Figures

OSCILLATING LAWN SPRINKLER

FIELD OF THE INVENTION

This invention relates generally to a novel lawn sprinkler.

DESCRIPTION OF THE PRIOR ART

The prior art, as exemplified by U.S. Pat. Nos. 2,634,163; 3,874,588; 2,909,325 and 3,355,110 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in an oscillating lawn sprinkler which gives more uniform distribution of water and includes a base, a water driven-motor mounted in the base, a crown gear attached to the base, a pinion on the gear meshing therewith, a link having one end connected to the center of the pinion and the other to the drive shaft of the motor concentric with the gear and a connecting rod pivoted to the perimeter of the pinion gear and to one end of rocking arm of the sprinkler outlet.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENTS

Figure 1:
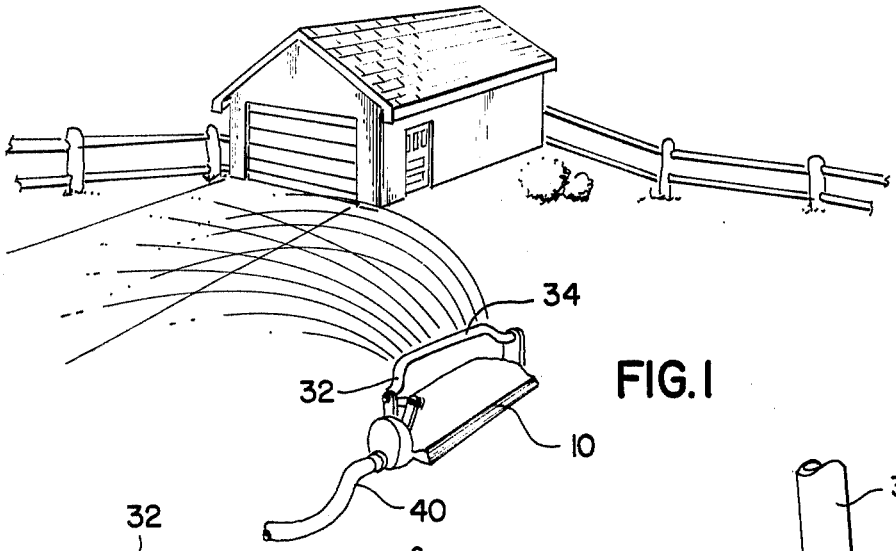
FIG. 1 is a view in perspective showing the sprinkler being used.

With reference to the drawing, there is shown and illustrated a novel sprinkler constructed in accordance with the principles of the invention and designated generally by reference character 10. The illustrated tangible embodiment of the invention includes a base 12 housing a water-driven motor on whose shaft 14 is keyed on end of link 18. A pinion gear 20 is rotatably mounted on the other end of link 18 by pin 22. Pinion gear 20 is adapted to mesh with crown gear 16 concentrically mounted about shaft 12 and fixed to base 12.

In prior art devices of this type, a connecting rod would be connected from the motor rotor to the rocker arm actuating the sprinkling outlet.

Here, instead, one end of connecting rod 24 is pivoted on the circumference of pinion gear 20 on pin 26. The other end of rod 24 is fulcrumed by pin 28 on the end of lever 30 which is integral with sprinkler head or rocker arm 32 whose upper end rocks sprinkling outlet 34 (FIG. 1). For best results, it has been found necessary that angle B between lever 30 and sprinkler head 32 be between one-hundred and one-hundred-ten degrees, with one-hundred-six degrees being the optimum angle found best by test. Arm 32 is fulcrumed at 36 on bracket 38 fixed to base 12.

Motor 23 is driven in conventional manner by water flowing from water supply hose 40 through sprinkling head 32.

As will be seen from FIGS. 2–5, pinion 22 rotates inside crown gear 16. While crown gear 16 fixed to the base, as is motor 23, the pinion gear rotates and revolves within crown gear 16 causing the connecting rod 24 to move up and down at all times.

As shown in FIGS. 2-5, motor shaft 14 and link 18 rotate clockwise, with pinion gear rotating about pin 22 in the counterclockwise direction.

Figure 2:
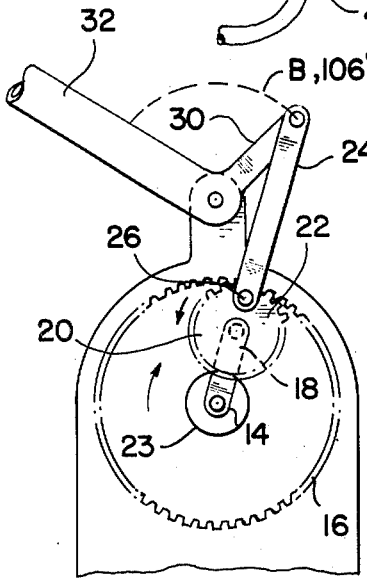
FIGS. 2–5 are partial front elevational views showing different positions of the oscillating mechanism of the sprinkler
Figure 3:
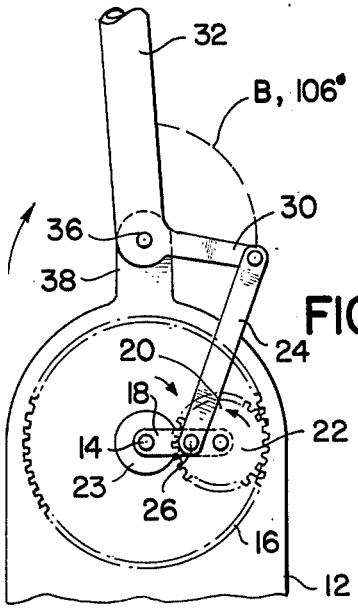
Figure 4:
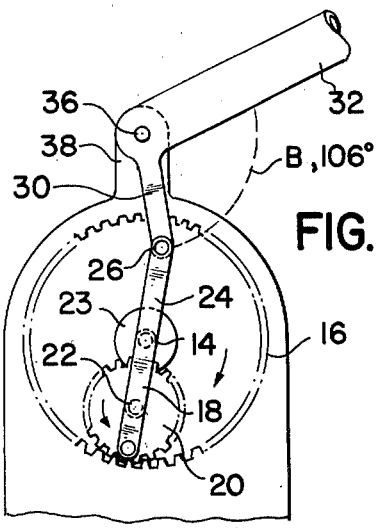
Figure 5:
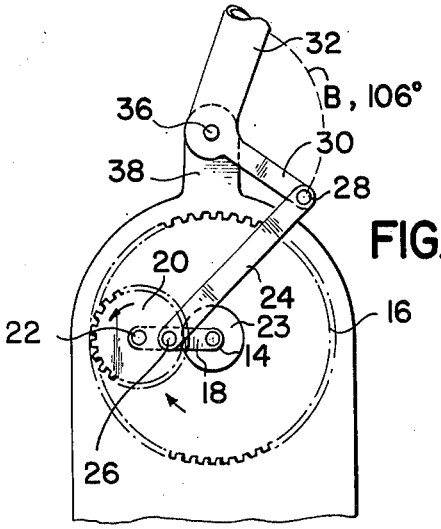

Considering first FIG. 2 the axis of rod 24 is about seventeen degrees from the vertical. In FIG. 3, the pinion will come down about seventeen degrees and in FIG. 5, the pinion will come up about seventeen degrees to be at right angles to line X-4 of FIG. 1. The sprinkling device 34 is connected to a water supply hose 40.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. An oscillating lawn sprinkler comprising a base, a motor mounted on the base and having a rotor actuated thereby, a crown gear fixed to said base concentrically about said rotor; a pinion gear engaged by said crown gear; a link fixed to the rotor and to an end of which the pinion gear is rotatably mounted; a sprinkling outlet on said base including a rocker arm pivoted on said base and having a lever end integral therewith at a lower end thereof, said arm and said lever end forming an obtuse angle therebetween and a connecting rod pivoted to the lower end of said lever arm and to the perimeter of said pinion gear whereby said rod continually travels in both an axial direction and in an orbital direction as said pinion gear rotates.

2. The invention as recited in claim 1, wherein said angle is between one-hundred and one-hundred-ten-degrees.

3. The invention as recited in claim 2, wherein said angle is about one-hundred-six degrees.

* * * * *